US005887309A

United States Patent [19]

Lin

[11] Patent Number: 5,887,309

[45] Date of Patent: Mar. 30, 1999

[54] SPONGE MOP

[76] Inventor: Yung-Cheng Lin, 439, Chiu Fen Road, Yung Ching Hsiang, Changhua, Taiwan, Taiwan

[21] Appl. No.: 3,524

[22] Filed: Jan. 6, 1998

[51] Int. Cl.[6] ..... A47L 13/257

[52] U.S. Cl. ..... 15/119.2; 15/116.2

[58] Field of Search ..... 15/116.1, 116.2, 15/119.1, 119.2

[56] References Cited

FOREIGN PATENT DOCUMENTS 1218513 1/1971 United Kingdom ..... 15/119.2
2122073 1/1984 United Kingdom ..... 15/119.1

*Primary Examiner*—Terrence R. Till
*Attorney, Agent, or Firm*—Smith, Gambrell & Russell; Beveridge, DeGrandi, Weilacher & Young Intellectual Property Group

[57] ABSTRACT

A sponge mop is composed of a handle, a lever, a rotary sleeve, a socket, a mophead seat, a sponge body, and two link rods. The lever and the mophead seat are connected by the two link rods. The lever is fastened pivotally with the handle which is in turn engaged at one end thereof with the rotary sleeve. The rotary sleeve is engaged at another end thereof with the socket which is in turn engaged at another end thereof with the mophead seat. As the rotary sleeve is rotated, the link rods are actuated by the handle to enable the mophead seat to swivel.

1 Claim, 4 Drawing Sheets

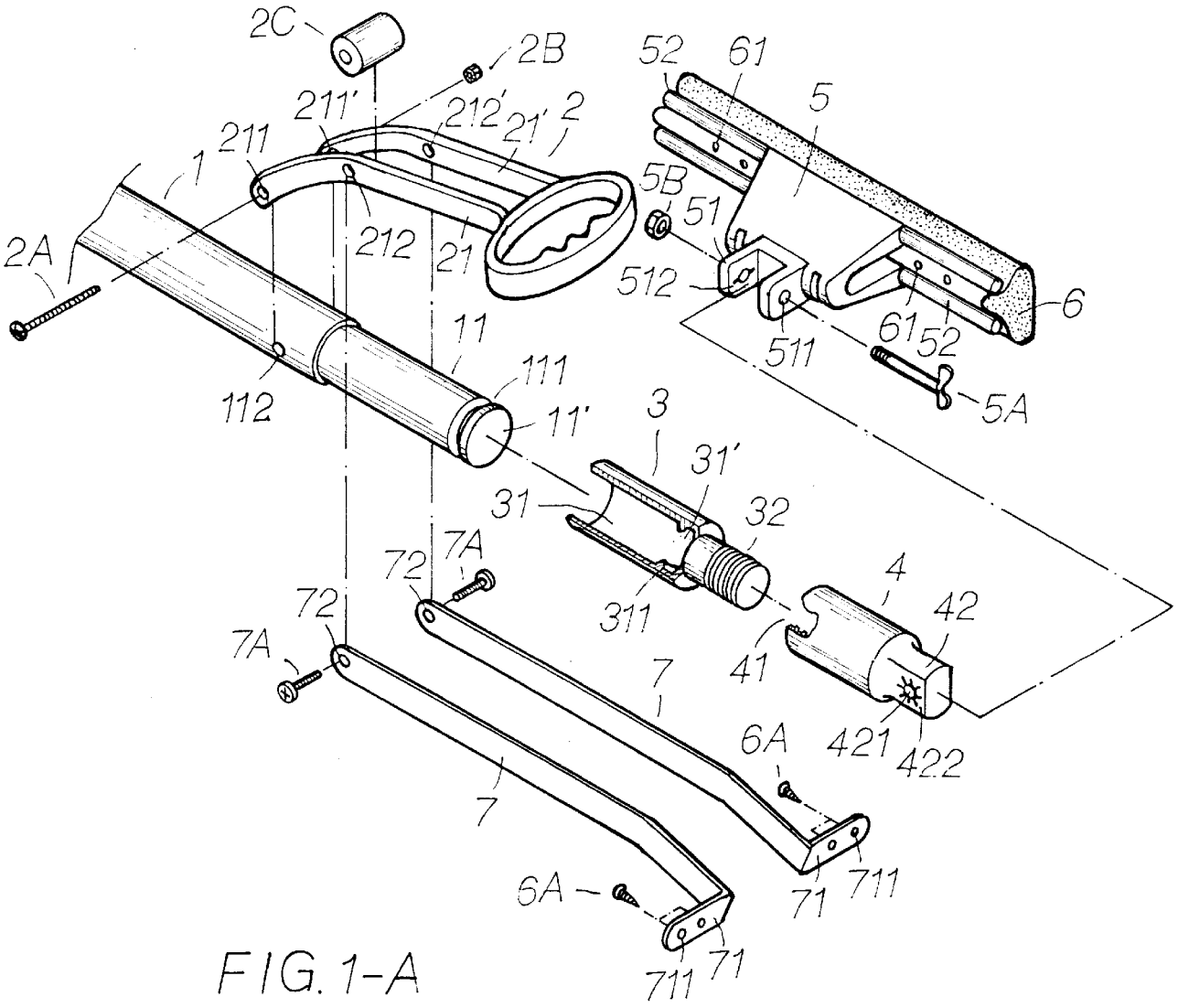
FIG. 1-A

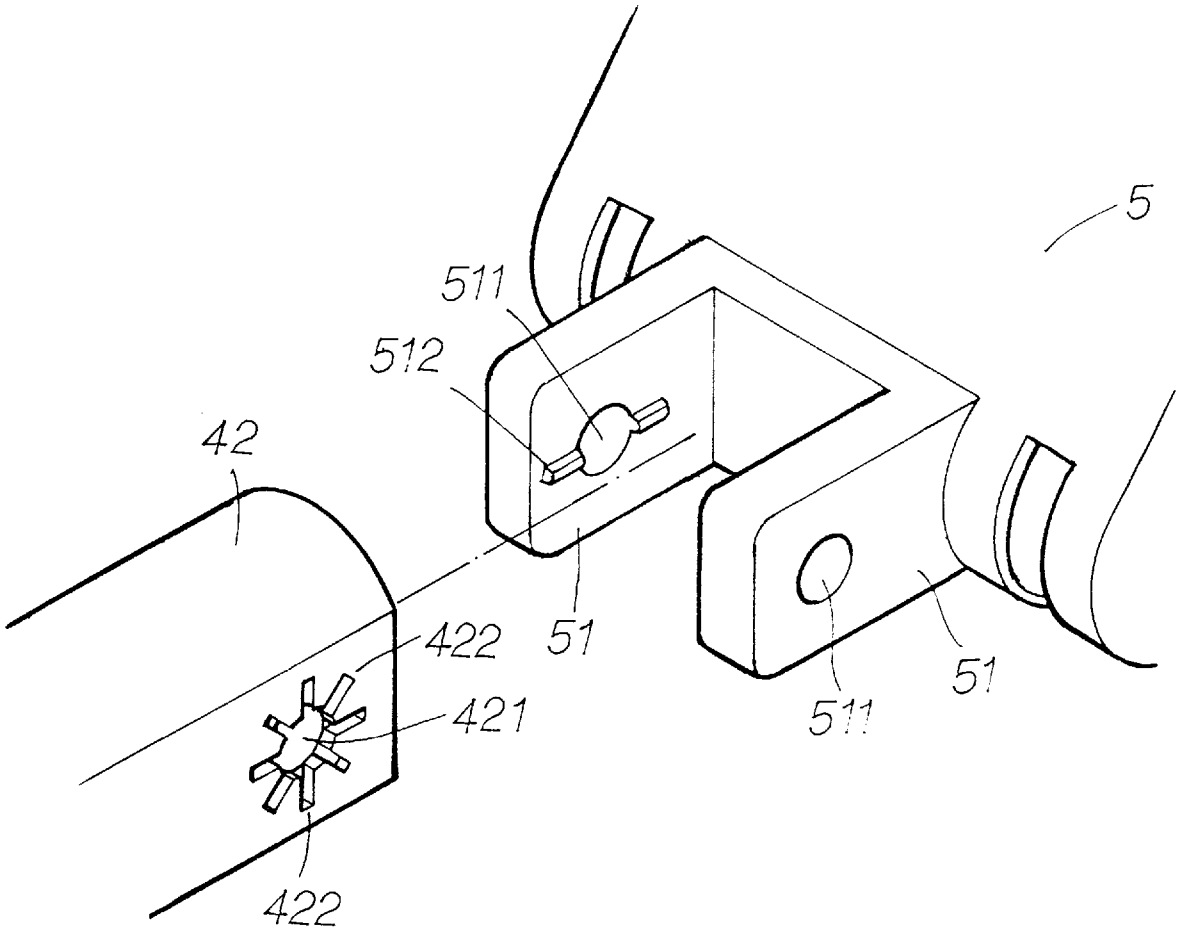
FIG. 1-B

SPONGE MOP

FIELD OF THE INVENTION

The present invention relates generally to a floor cleaning equipment, and more particularly to a sponge mop.

BACKGROUND OF THE INVENTION

The conventional sponge mops are generally made up of a straight handle, and a mop head which is fastened with one end of the straight handle. In order to facilitate the mopping, the handle is held such that the handle and the floor surface from an inclination. As a result, the sponge of the mop head is rather prone to wear. The conventional sponge mops are improved such that they are provided with a curved handle capable of minimizing the wear of the sponge of the mop head. However, the process of making the curved handle of a sponge mop calls for additional capital investment in the molding tool. In addition, the sponge of the mop head of the conventional sponge mops is vulnerable to deformation.

SUMMARY OF THE INVENTION

The primary objective of the present invention is therefore to provide an improved sponge mop free from the shortcomings of the conventional sponge mops.

In keeping with the principle of the present invention, the foregoing objective of the present invention is attained by a sponge mop which is mainly composed of a handle, a rotary sleeve, two link rods, a lever, and a mop head consisting of a sponge body. The lever and the mop head are connected by the two link rods. The lever is fastened pivotally with the handle which is engaged at one end thereof with the rotary sleeve. The rotary sleeve is engaged at another end thereof with a socket which is in turn engaged by the handle at such time when the rotary sleeve is rotated, thereby causing the sponge body to be in intimate contact with a holding plate of the mop head. The mop head can be caused to swivel by manipulating the lever.

The foregoing objective, features and functions of the present invention will be more readily understood upon a thoughtful deliberation of the following detailed description of a preferred embodiment of the present invention with reference to the accompanying drawings.

BRIEF DESCRIPTION OF THE DRAWINGS

FIG. 1-A shows an exploded view of the socket of the preferred embodiment of the present invention.

FIG. 1-B shows a partial enlarged view of the socket and the mop head seat of the present invention.

DETAILED DESCRIPTION OF THE EMBODIMENT

Figure 5:
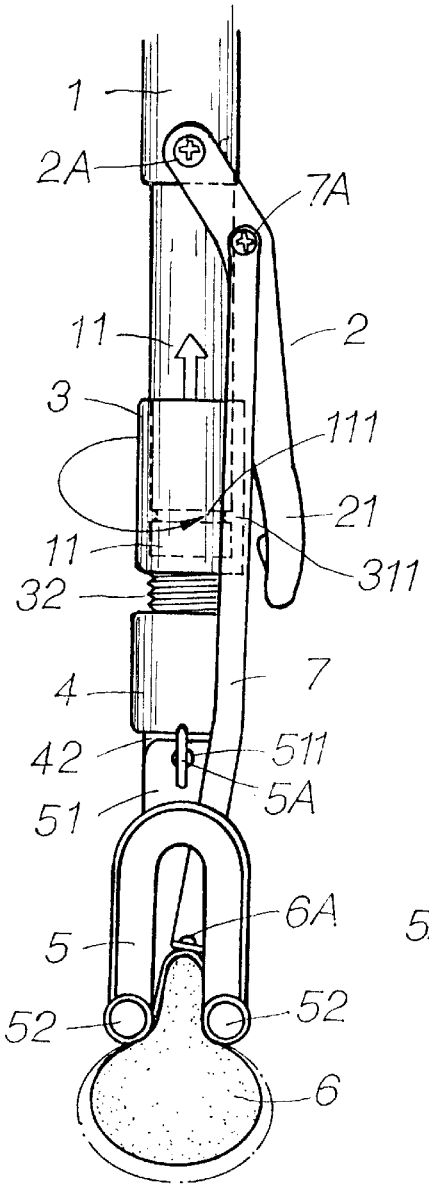
FIG. 5 shows a schematic view of the present invention at work.

As shows in all drawings provided herewith, a sponge mop embodied in the present invention is composed of a handle 1, a lever 2, a rotary sleeve 3, a socket 4, a mop head seat 5, a sponge body 6, and two link rods 7.

The handle 1 has a connection column 11 located at one end thereof and terminated with an end section 11'. The handle 1 is provided with a circular groove 111 located at the junction of the connection column 11 and the end section 11'. The handle 112 contiguous to the connection column 11.

The lever 2 consists of two connection rods 21 and 21', which are provided respectively at one end thereof with a round through hole 211, 211'. The connection rods 21 and 21' are further provided respectively with a through hole 212, 212'. The lever 2 is fastened pivotally at one end thereof with the handle 1 by a nut 2B and a bolt 2A which is received in the round hole 112 of the handle 1 and the round through holes 211 and 211' of the lever 2.

The rotary sleeve 3 is provided at one end thereof with a hollow interior 31 having a circular projection 311 and a retaining slot 31'. The rotary sleeve 3 is further provided at another end thereof with a threaded extension 32. The connection column 11 of the handle 1 is fitted into the hollow interior 31 of the rotary sleeve 3 such that the end section 11' of the connection column 11 is retained by the retaining slot 31' of the rotary sleeve 3.

The socket 4 is provided at one end thereof with a threaded hole 41, and at another end thereof with a rectangular extension 42 having a round through hole 421 which is provided with a plurality of recesses 422 radiating from the round through hole 421. The threaded hole 41 of the socket 4 is engaged with the threaded extension 32 of the rotary sleeve 3.

The mop head seat 5 is provided at one end thereof with two lugs 51 each having a through hole 511 and a protruded strip 512 located in the inner side of the lug 51. The mop head seat 5 is further provided at another end thereof with a sponge body plate 52 opposite in location to the lugs 51. The rectangular extension 42 of the socket 4 is fastened between the two lugs 51 of the mop head seat 5 in conjunction with a nut 5B and a bolt 5A which is received in the round through hole 421 of the socket 4 and the through holes 511 of the lugs 51 of the mop head seat 5.

The sponge body 6 is held by the sponge body plate 52 of the mop head seat 5 and is provided with a plurality of fastening holes 61.

The link rods 7 are of an L-shaped construction. Each of the two link rods 7 is provided at the end of a long arm thereof with a round hole 72 and is further provided at the short arm 71 thereof with a plurality of through holes 711. The link rods 7 are fastened with the lever 2 and the sponge body 6 such that the free ends of the long arms of the link rods 7 are fastened with the two connection rods 21 and 21' of the lever 2 by means of two screws 7A which are received in the round holes 72 of the link rods 7 and the round through holes 212 and 212' of the connection rods 21 and 21' of the lever 2, and that the short arms 71 of the link rods 7 are fastened with the sponge body 6 by means of a plurality of screws 6A which are engaged with the through holes 711 of the short arms 71 of the link rods 7 and the fastening holes 61 of the sponge body 6.

Figure 2:
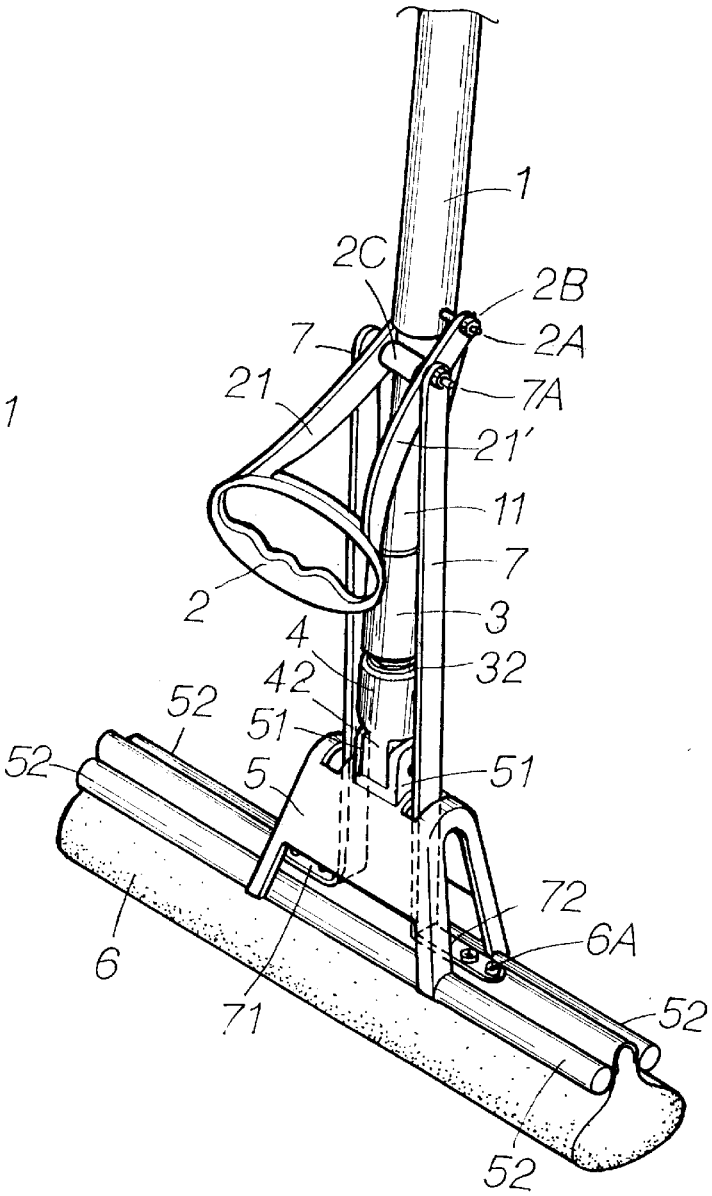
FIG. 2 shows a perspective view of the present invention in combination.
Figure 4:
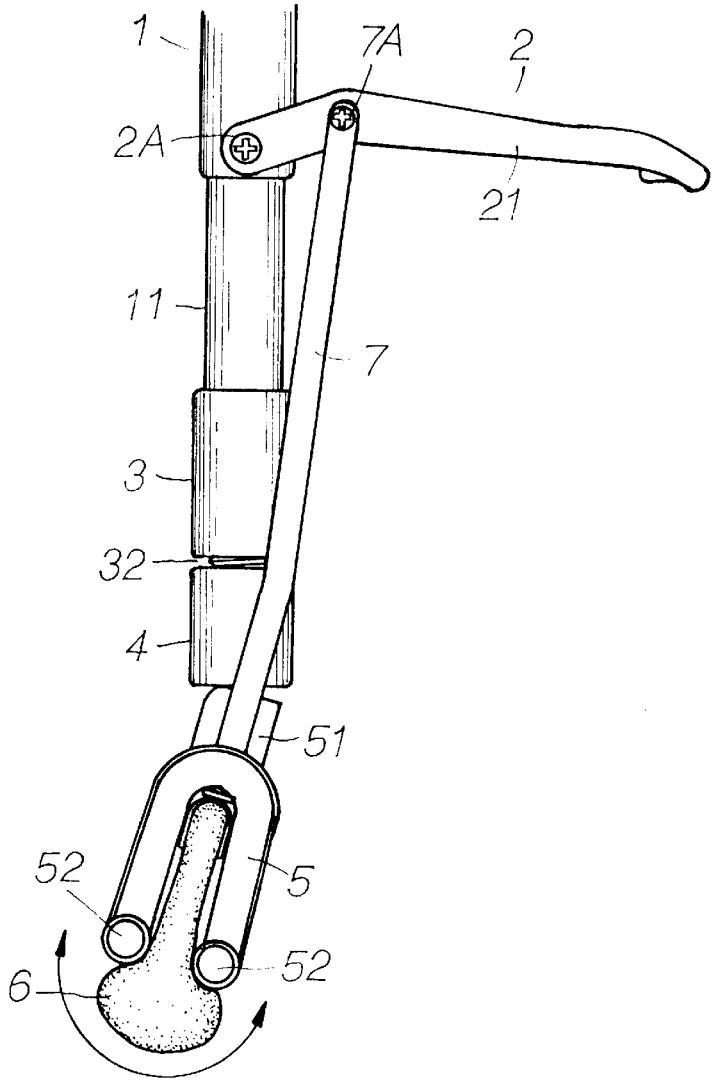
FIG. 4 shows another side view of the present invention in combination.
Figure 3:
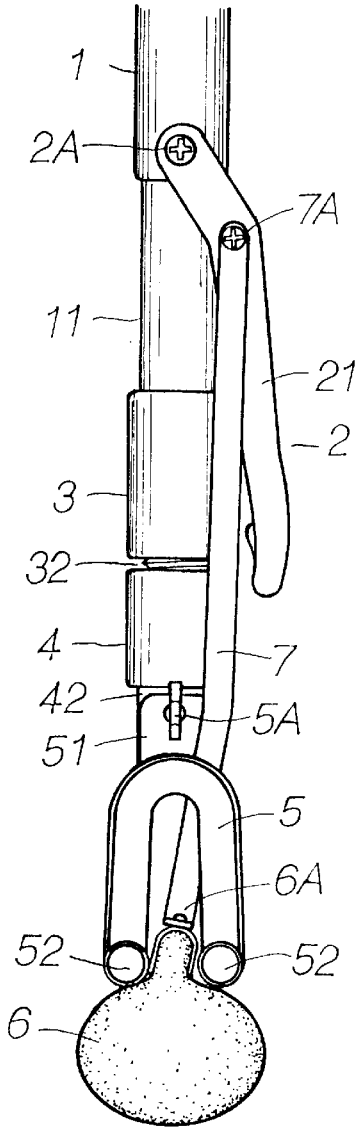
FIG. 3 shows a side view of the present invention in combination.

As shown in FIGS. 2 and 3, the sponge mop of the present invention is straight, in view of the fact that the protruded strips 512 of the two lugs 51 of the mop head seat 5 are engaged with the recesses 422 of the socket 4. The protruded strips 512 can be disengaged with the recesses 422 by loosening the bolt 5A, thereby enabling the mop head seat 5 to swivel, as shown in FIG. 4. After the mop head seat 5 is swiveled to locate at a desired position at which the protruded strips 512 of the lugs 51 of the mop head seat 5 are engaged once again with the recesses 422 of the socket 4.

After a prolong use of the sponge mop of the present invention, the sponge body 6 is likely to deform or shrink. The rotary sleeve 3 can be rotated, as illustrated in FIG. 5. Such that the handle 1, the link rods 7, the mop head seat 5, and the sponge body 6 held securely together.

What is claimed is:

1. A sponge mop comprising:

a handle having a connection column located at one end thereof and terminated with an end section, said handle provided with a circular groove located at a junction of said connection column and said end section, said handle further provided with a round hole contiguous to said connection column;

a lever consisting of two connection rods which are provided respectively at one end thereof with a round through hole and at a mid-segment thereof with a through hole, said lever being fastened pivotally at one end thereof with said handle by a bolt received in said round hole of said handle and said round through holes of said lever;

a rotary sleeve provided at one end thereof with a hollow interior having a circular projection and a retaining slot, said rotary sleeve further provided at another end thereof with a threaded extension, said hollow interior is engaged with said connection column of said handle, and that said retaining slot of said rotary sleeve is engaged with said end section of said connection column of said handle;

a socket provided at one end thereof with a threaded hole, and at another end thereof with a rectangular extension having a round through hole and a plurality of recesses radiating from said round through hole, said socket being engaged with said rotary sleeve such that said threaded extension of said rotary sleeve is rotatebly engaged with said threaded hole of said socket;

a mophead seat provided at one end thereof with two lugs each having a through hole and a protruded strip located in an inner side of said lug such that said protruded strip is engageable with any one of said recesses of said rectangular extension of said socket, said mophead seat further provided at another end thereof with a sponge body plate opposite in location to said lugs, said mophead seat being engaged with said socket such that said rectangular extension of said socket is fastened between said two lugs of said mophead seat in conjunction with a bolt received in said round through hole of said socket and said through holes of said lugs of said mophead seat;

a sponge body held by said sponge body plate of said mophead seat and provided with a plurality of fastening holes; and two link rods of an L-shaped construction and having a long arm and a short arm perpendicular to said long arm, said long arm provided at one end thereof with a round hole, said short arm provided with a plurality of through holes corresponding in number and location to said fastening holes of said sponge body, said link rods being fastened with said lever and said sponge body such that said long arms of said link rods are fastened with said connection rods of said lever by two fastening screws received in said round holes of said long arms of said link rods and said round through holes of said connection rods of said lever, and that said short arms of said link rods are fastened with said sponge body by a plurality of fastening screws which are engaged with said fastening holes of said sponge body via said through holes of said short arms of said link rods.

* * * * *